US007088931B2

(12) United States Patent
Kojima

(10) Patent No.: US 7,088,931 B2
(45) Date of Patent: Aug. 8, 2006

(54) IMAGE FORMING APPARATUS CAPABLE OF CHANGING IMAGE FORMING DIRECTIONS AND ITS FIXING DEVICE

(75) Inventor: Takeshi Kojima, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 123 days.

(21) Appl. No.: 10/836,427

(22) Filed: May 3, 2004

(65) Prior Publication Data

US 2005/0244174 A1 Nov. 3, 2005

(51) Int. Cl.
*G03G 15/00* (2006.01)

(52) U.S. Cl. ..... 399/38; 399/67; 399/68

(58) Field of Classification Search ..... 399/33, 399/38, 67, 68, 69, 328; 219/216, 470, 619, 219/671; 347/156
See application file for complete search history.

(56) References Cited

U.S. PATENT DOCUMENTS 6,587,654 B1 * 7/2003 Nishi ..... 399/67
6,889,018 B1 * 5/2005 Kinouchi et al. ..... 399/69
6,920,294 B1 * 7/2005 Takano ..... 399/69
6,937,827 B1 * 8/2005 Katoh et al. ..... 399/68

FOREIGN PATENT DOCUMENTS

JP 6-186883 A 7/1994
JP 10-301436 A 11/1998

* cited by examiner

*Primary Examiner*—Hoan Tran
(74) *Attorney, Agent, or Firm*—Foley & Lardner LLP

(57) ABSTRACT

An image forming apparatus of the present invention capable of changing the image forming direction detects the surface temperatures at the central part and edges of a fixing member, when an abnormal temperature rise or temperature insufficiency occurs at the ends, rotates the image forming direction by a controller, changes the width of a recording medium passing the fixing member, and executes fixing without using the ends of an abnormal temperature rise or temperature insufficiency. By doing this, regardless of an abnormal temperature rise or temperature insufficiency on the tops of the ends of the fixing member, fixed toner images of high image quality can be obtained efficiently without interrupting the image forming steps.

15 Claims, 6 Drawing Sheets

IMAGE FORMING APPARATUS CAPABLE OF CHANGING IMAGE FORMING DIRECTIONS AND ITS FIXING DEVICE

BACKGROUND OF THE INVENTION

1. Field of the Invention

The present invention relates to an image forming apparatus which has a fixing member for heating, pressurizing, and fixing a toner image and can change the image forming direction for forming a toner image according to the temperature of the fixing member and a fixing device of the image forming apparatus.

2. Description of the Related Art

As a fixing device used in a copier of an electro-photographic method or a printer, there is a fixing device available for inserting a recording medium between fixing rollers composed of a heating roller and a pressure roller or fixing belts composed similarly and heating, pressurizing, and fixing a toner image.

In such a fixing device, like small-sized recording media or recording media to be conveyed in the vertically long direction (R direction), when recording media narrower than the width of the fixing device are continuously fed, at the end of the fixing device, heat is not transferred by paper feed and the surface temperature rises abnormally. When the fixing step of using the end of the fixing device is executed next in this state, image defects may be caused at the image end due to high-temperature offset or image quality defects may be caused in recording media due to shrinkage or crinkles. On the other hand, when recording media are continuously fed in the state that those media are conveyed in the horizontally long direction and the fixing device is used up to the end thereof, the end of the fixing device is lowered in temperature compared with the central part thereof due to radiation of heat to the outside and fixing defects may be caused due to an insufficient temperature.

Therefore, conventionally, in Japanese Patent Disclosure No. 6-186883, a fixing device for controlling heat generation of a heater from detected values of a temperature detection element at the central part of a heating roller and a temperature detection element at the end thereof and controlling the temperature of the heating roller is disclosed. The conventional fixing device detects the surface temperature of the heating roller to realize energy conservation. Furthermore, in Japanese Patent Disclosure No. 10-301436, a fixing device for detecting the surface temperature at the central part of a heating roller and the surface temperature at the end thereof, and when the surface temperature at the end is low, controlling a heater, and preventing image detects due to an insufficient temperature at the end is disclosed.

However, in the aforementioned fixing devices, the heater is controlled, thus the surface temperature of the heating roller is controlled. Therefore, when the heating roller abnormally rises in temperature or is insufficient in temperature, it forces feed of recording media to wait once until the heater is controlled and the temperature of the heating roller reaches the control temperature realizing satisfactory fixing. And, after waiting for feed of recording media, when the heating roller reaches the control temperature, the fixing operation must be restarted. Therefore, the image forming speed is decreased and the productivity is prevented from improvement.

Therefore, an image forming apparatus in which fixed images of high image quality can be obtained by a heating, pressurizing, and fixing device, and the image forming operation can be speeded up easily, and the image forming direction can be changed and a fixing device of the image forming apparatus are desired.

SUMMARY OF THE INVENTION

An object of the present invention, in an image forming apparatus capable of changing the image forming direction and a fixing device of the image forming apparatus, is not to wait for arrival of the heating, pressuring, and fixing device at a predetermined control temperature, to prevent an occurrence of defective fixing due to an abnormal temperature rise or temperature insufficiency of the heating, pressurizing, and fixing device, and to obtain fixed images of high image quality at high speed.

According to the embodiments of the present invention, there is provided an image forming apparatus capable of changing an image forming direction, comprising: an image forming unit configured to form a toner image on a recording medium; a fixing member to hold and convey the recording medium and heat, press, and fix the toner image on the recording medium; a heating member to heat the fixing member; a center thermistor to detect a surface temperature at a central part of the fixing member; a side thermistor to detect a surface temperature at an end of the fixing member; a feed portion configured to feed the recording medium to the image forming unit; and a controller configured to judge the surface temperature at the end of the fixing member, rotate and control a forming direction of the toner image by the image forming unit, and select and control the recording medium arranged in the same direction as the forming direction of the toner image from the feed portion.

Furthermore, according to the embodiments of the present invention, there is provide an image forming apparatus capable of changing an image forming direction, comprising: an image forming unit configured to form a toner image on a recording medium; a fixing member to hold and convey the recording medium and heat, press, and fix the toner image on the recording medium; a heating member to heat the fixing member; a center thermistor to detect a surface temperature at a central part of the fixing member; a side thermistor to detect a surface temperature at an end of the fixing member; a feed portion configured to feed the recording medium to the image forming unit; a finish discrimination portion to discriminate an ejection state of the recording medium after passing of the fixing member; and a controller configured to judge the surface temperature at the end of the fixing member and the discrimination result by the finish discrimination portion, rotate and control the forming direction of the toner image by the image forming unit, and select and control the recording medium arranged in the same direction as the forming direction of the toner image from the feed portion.

Furthermore, according to the embodiments of the present invention, there is provided a fixing device of an image forming apparatus, comprising: a fixing member to hold and convey a recording medium and heat, press, and fix a toner image formed on the recording medium; a heating member including a center heating member to heat a central part of the fixing member and side heating members provided on both sides of the center heating member to heat sides of the fixing member; a center thermistor to detect a surface temperature at the central part of the fixing member; a side thermistor to detect a surface temperature on a side of the fixing member; and a controller configured to drive and control alternately the center heating member and the side heating member so as to keep the fixing member at a control temperature from detected results by the center thermistor and detected results by the side thermistor.

DETAILED DESCRIPTION OF THE INVENTION

Figure 1:
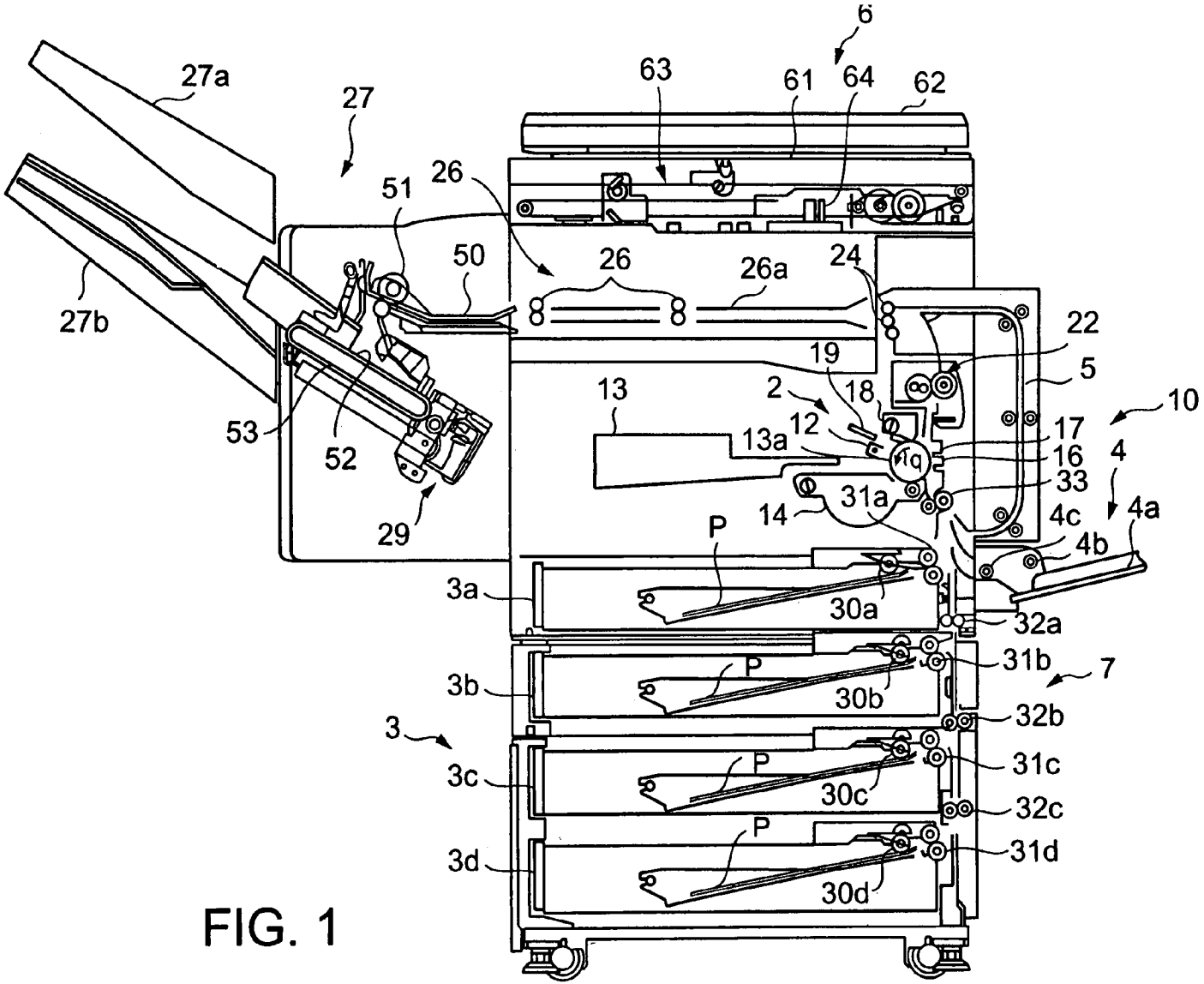
FIG. 1 is a schematic block diagram of the image forming apparatus of the first embodiment of the present invention.

The first embodiment of the present invention will be explained in detail below with reference to the accompanying drawings. FIG. 1 is a schematic block diagram showing image forming apparatus 10 of the first embodiment of the present invention. Image forming apparatus 10 has cassette mechanism 3, which is a feed portion, having cassettes 3*a* to 3*d* for feeding sheet of paper P, which is a recording medium, toward image forming portion 2 for forming a toner image. The uppermost stage of cassette mechanism 3 is horizontally long cassette 3*a* for storing a sheet of paper of a size of A4 in the horizontally long direction and the second stage is vertically long cassette 3*b* for storing a sheet of paper of a size of A4 in the vertically long direction (A4-R).

Between cassettes 3*a* to 3*d* and image forming portion 2, pickup rollers 30*a* to 30*d* for taking out the sheet of paper P, separation conveyors 31*a* to 31*d*, and conveyor mechanism 7 having first to third conveyor rollers 32*a* to 32*c* and register rollers 33 are installed.

Further, image forming apparatus 10 has manual paper supply mechanism 4 for separating sheet of paper P taken out by manual pickup roller 4*b* from paper feed tray 4*a* by separator 4*c* and feeding it toward image forming portion 2 and reversing path 5 for reversing sheet of paper P at the time of forming double-side images. On the top of image forming apparatus 10, scanner 6 for reading a document image is installed. Scanner 6 has document glass 61 for loading a document, platen 62 for covering document glass 61, optical unit 63 for irradiating light to the document and focusing reflected light from the document, and CCD scanner unit 64 for reading light from optical unit 63.

Figure 2:
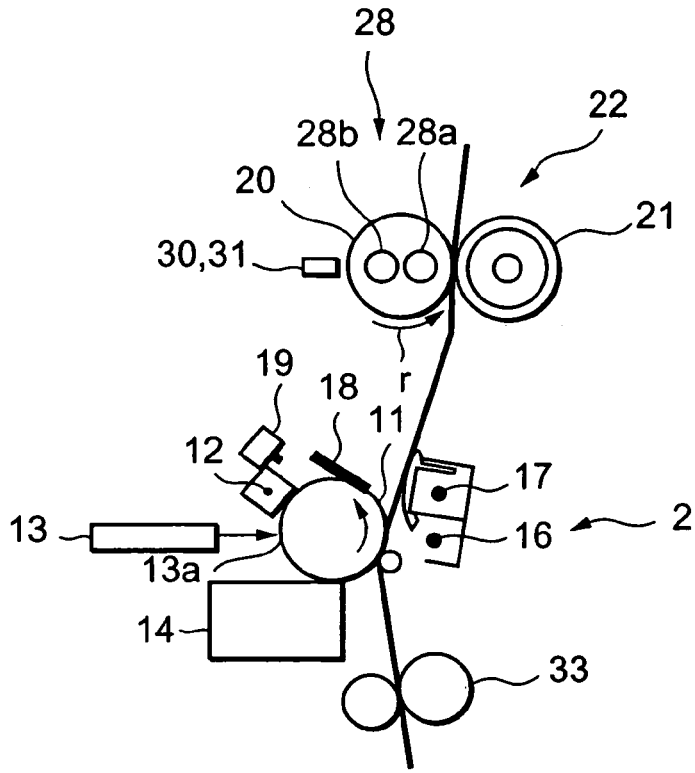
FIG. 2 is a block diagram showing the image forming portion of the first embodiment of the present invention.

Image forming portion 2, as shown in FIG. 2, around photosensitive drum 11, in the rotational direction of arrow q of photosensitive drum 11, sequentially has main charger 12 for evenly charging photosensitive drum 11, exposure portion 13*a* of laser exposure 13 for forming a latent image on charged photosensitive drum 11 on the basis of image data from scanner 6, developing unit 14, transfer charger 16, separation charger 17, cleaner unit 18, and discharging LED 19. Developing unit 14 uses toner of a glass transition point of 58° as a developer.

On the downstream side in the conveying direction of sheet of paper P of image forming portion 2, there are fixing device 22, first paper ejection rollers 24, and finisher relay unit 26 provided. For sheet of paper P conveyed by finisher relay unit 26, finisher 27 having upper stack tray 27*a*, lower stack tray 27*b*, and staple unit 29 is installed. Finisher relay unit 26 has relay guide 26*a* and relay rollers 26*b*. Finisher 27 has second paper ejection roller 51 for ejecting sheet of paper P ejected from finisher relay unit 26 to paper path 50 to upper stack tray 27*a* or lower stack tray 27*b*.

Furthermore, finisher 27 has intermediate processing tray 52 and bundle ejection belt 53 for performing the staple process by staple unit 29.

Figure 3:
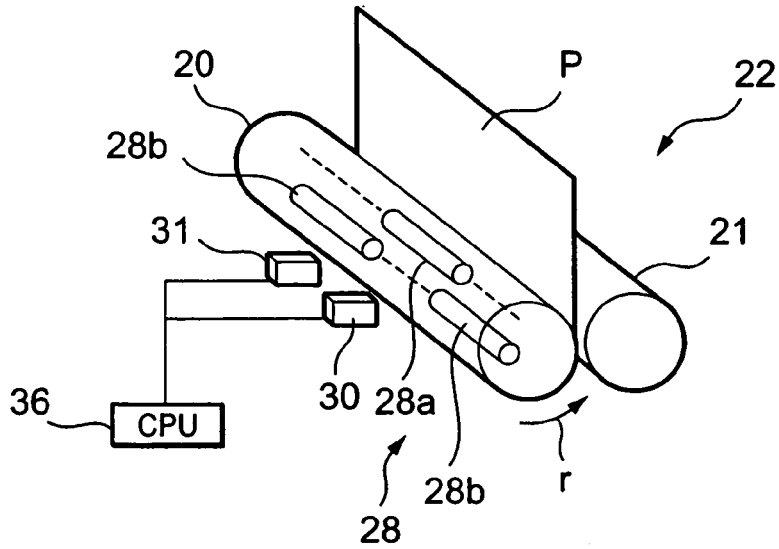
FIG. 3 is an illustration showing the fixing device of the first embodiment of the present invention when a sheet of paper in the horizontally long direction is fixed.
Figure 4:
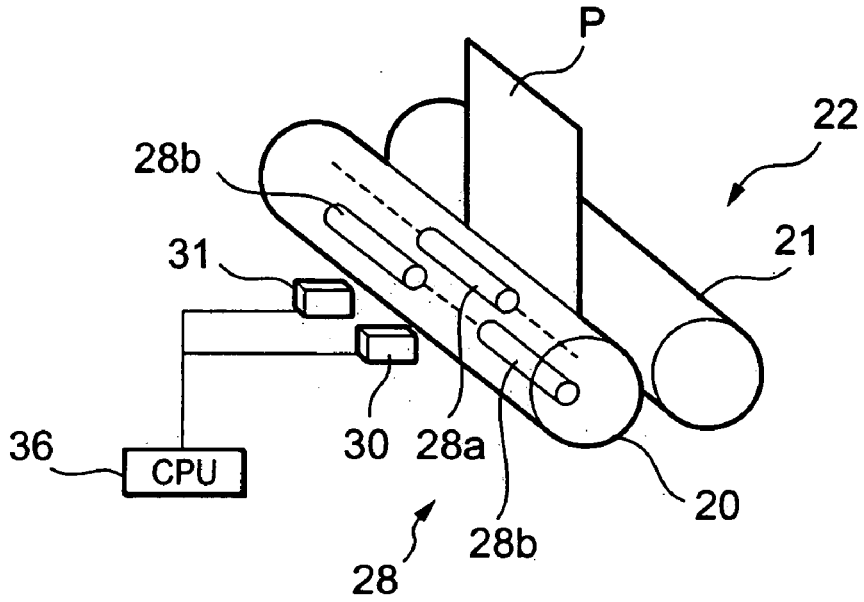
FIG. 4 is a schematic illustration showing the fixing device of the first embodiment of the present invention when a sheet of paper in the vertically long direction is fixed.

Fixing device 22, as shown in FIGS. 3 and 4, has heat roller 20 having built-in heater lamp 28 which is a heating member and press roller 21. Heat roller 20 and press roller 21 are in press-contact with each other to form a fixing member, and press roller 21 is in rolling-contact with heat roller 20 driven by the driving source, and sheet of paper P is held and conveyed between heat roller 20 and press roller 21 and a toner image is heated, pressurized, and fixed.

Heat roller 20 is composed of a core metal made of aluminum with a diameter of 30 mm and a thickness of 0.8 mm which is coated with a surface layer such as heat-resistant silicone rubber. Heat roller 20 has a length of about 370 mm in the axial direction. Press roller 21 is composed of a stainless steel roller with a diameter of 20 mm which is coated with a rubber tube and furthermore, as a surface layer, coated with a PFA layer which is a copolymer of tetrafluoroethylene and perfluoroalkylvinylether. Press roller 21 has a length of about 315 mm in the axial direction. Press roller 21 is in press-contact with heat roller 20 at a fixing load of 400 N and the pressure is set so as to control the nip width between the two to 4 mm or more.

Heater lamp 28 in heat roller 20 is composed of center lamp 28*a* and side lamps 28*b* neighboring with the both sides of center lamp 28*a* so as to be overlapped partially. Center lamp 28*a* and side lamps 28*b* are driven to alternately light by CPU 36 which is a controller which will be described later and at the ready time of warming-up end, control the surface temperature of heat roller 20 to about 180° C. At the central part and end of the circumstance of heat roller 20, center thermistor 30 and side thermistor 31 for detecting the surface temperature of heat roller 20 are installed.

Figure 5:
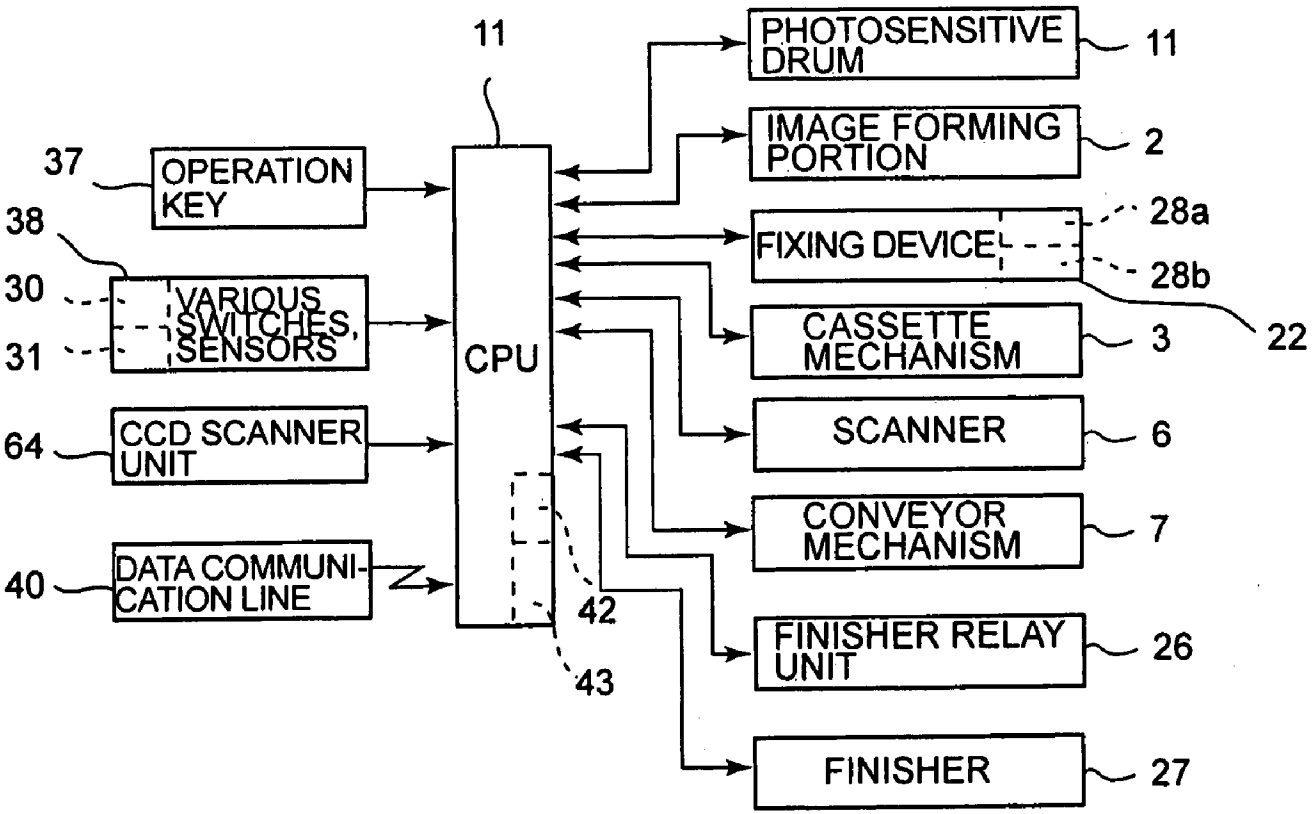
FIG. 5 is a schematic block diagram showing the essential section of the control system of the first embodiment of the present invention.

FIG. 5 is a block diagram showing the control system of image forming apparatus 10. To the input side of CPU 36 which is a controller for controlling whole image forming apparatus 10, operation key 37 on the operation panel for inputting the image forming conditions such as the pint mode, cassette selection, and the number of prints, various switches and sensors 38 including center thermistor 30 and side thermistor 31, and data communication line 40 for transmitting image information from CCD scanner unit 64 or the computer terminal are connected.

Furthermore, to CPU 36, photosensitive drum 11, image forming portion 2, fixing device 22 having center lamp 28*a* and side lamps 28*b*, cassette mechanism 3, scanner 6, conveyor mechanism 7, finish relay unit 26, and finisher 27 are connected.

CPU 36 has image processor 42 and finish discriminator 43.

Image processor 42, according to the surface temperature at the end of heat roller 20 detected by side thermistor 31, converts the address of the image information inputted from CCD scanner unit 64 or data communication line 40, thereby controls so as to rotate the forming direction of an image formed by image forming portion 2 in a 90° arc. The image information processed by image processor 42 is input to laser exposure 13. Further, finish discriminator 43 discriminates whether the finish process (for example, the sorting process or stable process) by finisher 27 is designated or not.

Further, CPU 36, according to the image forming direction controlled by image processor 42, selects and controls any of cassettes 3*a* to 3*d* of cassette mechanism 3.

Next, the operation of the invention will be described. When the power source is turned on, fixing device 22 starts the warm-up operation, controls so as to alternately turn on or off center lamp 28*a* and side lamps 28*b* until heat roller 20 reaches 180° C., and rotates heat roller 20 in the direction of arrow r. When both center thermistor 30 and side thermistor 31 detect that heat roller 20 reaches 180° C. after start of warm-up, a ready indication appears on the operation panel. Heat roller 20 stops the rotation after end of warm-up, thereafter controls so as to turn on or off center lamp 28*a* and side lamps 28*b*, and keeps heat roller 20 at about 180° C. which is a control temperature.

Thereafter, image forming apparatus 10, by input from operation key 37 or input from data communication line 40, starts the image forming process. When the image forming process starts, heat roller 20 and press roller 21 of fixing device 22 restart the press-contact rotation. In cassette mechanism 3, any of cassettes 3*a* to 3*d* is selected or manual paper supply mechanism 4 is selected.

For example, when the image forming process is started by input from operation key 37, a document is read by scanner 6, and the obtained image information is image-processed by image processor 42, and an image processing signal is input to laser exposure 13. In image forming portion 2, photosensitive drum 11, during rotation in the direction of arrow q, is evenly charged by main charger 12, is irradiated with a laser beam according to the image processing signal by laser exposure 13, and forms an electrostatic latent image. Next, the electrostatic latent image on photosensitive drum 11 is developed by developing unit 14 and a toner image is formed on photosensitive drum 11.

On the other hand, from cassette mechanism 3 or manual paper supply mechanism 4, predetermined sheet of paper P is supplied and is conveyed toward register rollers 33. Sheet of paper P whose end is arranged by register rollers 33 is conveyed to the position of transfer charger 16 in synchronization with the toner image on photosensitive drum 11 and after the toner image is transferred, is separated from photosensitive drum 11 by separation charger 17.

After separation of sheet of paper P, the residual toner on photosensitive drum 11 is cleaned by cleaner unit 18, and the residual charge is removed by discharging LED 19, and photosensitive drum 11 waits for the next image forming process.

Sheet of paper P having the toner image separated from photosensitive drum 11 is inserted between heat roller 20 and press roller 21 of fixing device 22 and the toner image is heated, pressurized, and fixed. After fixing, sheet of paper P is transferred to finisher 27 via finisher relay unit 26 by first paper ejection rollers 24 and is ejected to upper stack tray 27*a* or lower stack tray 27*b* by second paper ejection roller 51, and the image forming steps are finished.

When performing the staple process for sheets of paper P, the aforementioned image forming steps are repeated, and sheets of paper P are loaded and matched on finisher intermediate processing tray 52 and then are subject to the staple process by staple unit 29.

Next, the bundle of sheets of paper P subject to the staple process is ejected to upper stack tray 27*a* or lower stack tray 27*b* by bundle ejection belt 53 and the image forming steps are finished.

During execution of such image forming steps, in fixing device 22, center lamp 28*a* and side lamps 28*b* alternately light and keep the surface of heat roller 20 at about 180° C. which is a control temperature. However, for example, even if the image size is large like A-3 or B-4 and the image forming direction is formed as a vertically long direction, when the image width is a size using both ends of heat roller 20 or when an image is formed in the horizontally long direction and as shown in FIG. 3, both ends of heat roller 20 are used, if the image forming steps are continued, a phenomenon occurs that the ends of heat roller 20 lose heat due to fixing and the surface temperature is lowered due to radiation of heat to the circumference. However, during this period, the central part of heat roller 20 receives, in addition to heat from center lamp 28*a*, heat from side lamps 28*b* and keeps about 180° C. which is a control temperature.

Figure 6:
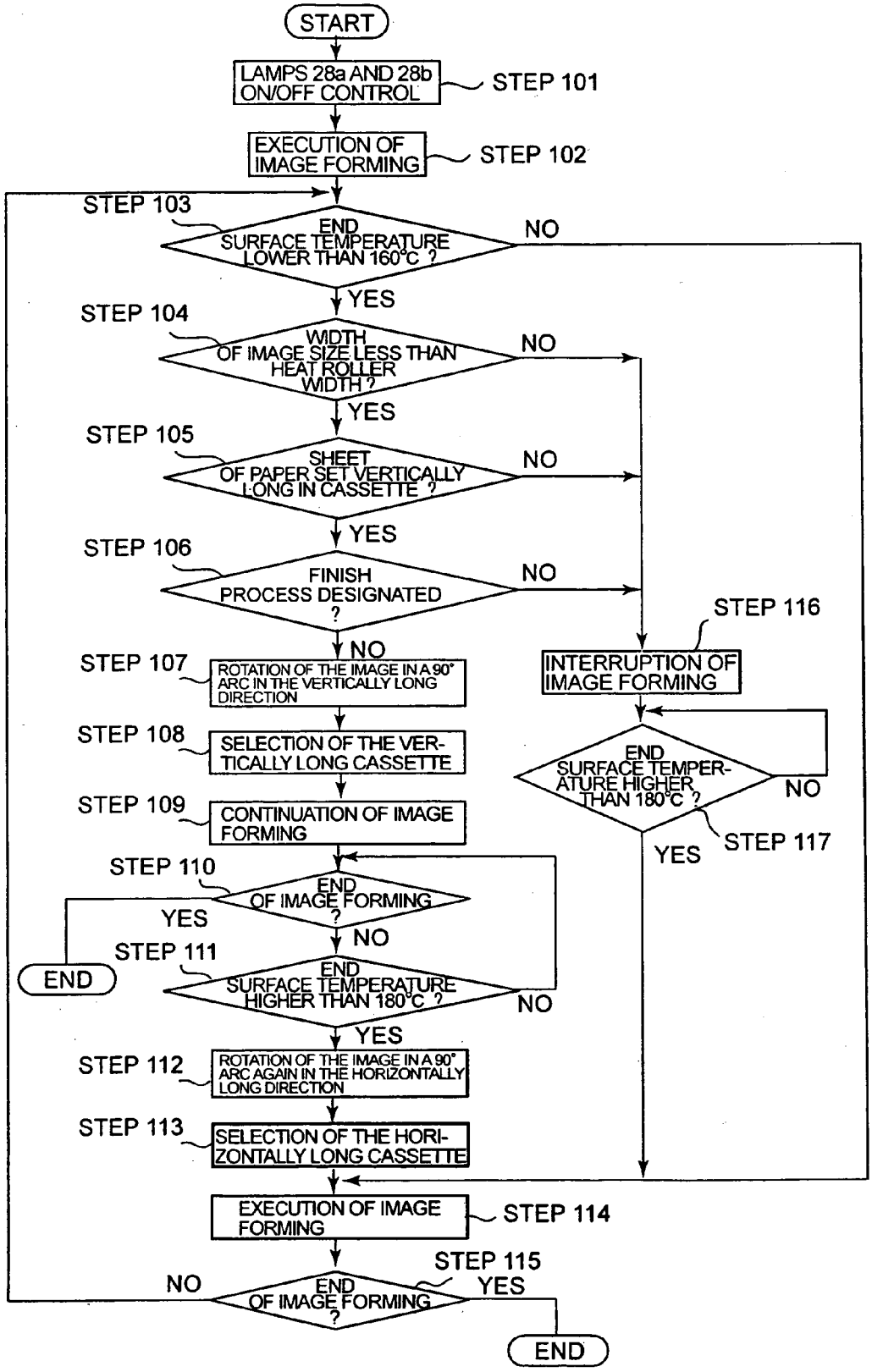
FIG. 6 is a flow chart showing control when the temperature at the end of the heat roller is lowered in the first embodiment of the present invention.

Next, control when the surface temperature at the ends of heat roller 20 is lowered by the continuous image forming steps as mentioned above will be explained in detail by referring to the flow chart shown in FIG. 6. In the flow chart, for example, a case that sheets of paper of a size of A4 are used will be described. As shown at Step 101, during ready after the power source is turned on, center lamp 28*a* and side lamps 28*b* of heat roller 20 are alternately controlled so as to be turned on or off and the surface temperature of heat roller 20 is kept at about 180° C. At Step 102, according to the aforementioned image forming steps, image forming is executed. At this time, in cassette mechanism 3, any of cassettes 3*a* to 3*d* for storing sheets of paper P according to the image size and image forming direction is selected or manual paper supply mechanism 4 is selected.

During continuation of the image forming steps, at Step 103, whether the surface temperature at the ends of heat roller 20 detected by side thermistor 31 is lower than 160° C. or not is compared. At Step 103, when the surface temperature at the ends of heat roller 20 is 160° C. or higher, the process goes to Step 114, and the image forming step is continued, and at Step 115, when the necessary number of images are formed, all the image forming steps are finished. At Step 115, when the image forming step is continued, the process returns to Step 103.

At the time of fixing at the image forming steps, both ends of heat roller 20 are continuously used and at Step 103, when it is detected by side thermistor 31 that the surface temperature at both ends of heat roller 20 is decreased lower than 160° C., the process goes to Step 104.

At Step 104, whether the width of the image size, even if image forming is executed in either of the horizontally long direction and the vertically long direction, is the width of the heat roller or narrower or not is compared. When the width of the image size is larger than the width of the heat roller, the process goes to Step 116, and when the width of the image size is the width of the heat roller or narrower, the process goes to Step 105. At Step 116, the image forming step is interrupted. Next, at Step 117, when side thermistor 31 detects that the surface temperature at the ends of heat roller 20 is increased to 180° C. or higher, the process goes to Step 114.

At Step 105, in correspondence to a case that the image forming direction is set to the vertically long direction, in cassette mechanism 3, whether sheet of paper P of a predetermined size is set in the vertically long direction (for example, A4-R, LT-R, or B5-R) or not is compared. When sheet of paper P is not set in the vertically long direction, the process goes to Step 116. In cassette mechanism 3, when sheet of paper P is set in the vertically long direction, the process goes to Step 106. At Step 106, finish discriminator 43 compares whether the finish process is designated by finisher 27. For example, when the discriminator 43 discriminates that the sorting process is designated, the process goes to Step 116 and when it discriminates that the sorting process is not designated, the process goes to Step 107.

At Step 107, not to use both ends of heat roller 20 at the time of fixing, image processor 42 converts the image address and rotates the image forming direction in a 90° arc to set the vertically long direction. Next, at Step 108, to change sheet of paper P, vertically long cassette 3*b* of cassette mechanism 3 is selected, and at Step 109, according to the aforementioned image forming step, image forming in the vertically long direction rotated in a 90° arc is executed. By doing this, at the time of fixing, as shown in FIG. 4, both ends of heat roller 20 are not used for fixing, so that no heat is taken by sheet of paper P and the surface temperature rises.

The image forming step is continued at Step 109 and after a lapse of a predetermined time, when the necessary number of images are formed at Step 110, all the image forming steps are finished. When the image forming step is continued at Step 110, at Step 111, whether the surface temperature at the ends of heat roller detected by side thermistor 31 reaches 180° C. or not is compared.

When it is lower than 180° C., the process returns to Step 110. At Step 111, when side thermistor 31 detects that the surface temperature at the ends of heat roller 20 is increased to 180° C. or higher, the process goes to Step 112.

At Step 112, image processor 42 converts the image address and rotates the image forming direction again in a 90° arc to convert it again to the horizontally long direction. Next, at Step 113, horizontally long cassette 3*a* for storing sheet of paper P in the horizontally long direction is selected again and at Step 114, the image forming step in the horizontally long direction rotated in a 90° arc is executed again. Furthermore, the process goes to Step 115 and depending on whether the necessary number of images are formed or not, the process returns to Step 103 or all the image forming steps are finished.

Therefore, during the image forming step, when the surface temperature at the ends of heat roller 20 is decreased to lower than 160° C., the width of the image size, in either of the horizontally long direction and the vertically long direction, is the width of the heat roller or narrower and when sheet of paper P in the vertically long direction is set and the finish process is not performed by finisher 27, to wait for rising of the surface temperature at the ends of heat roller 20, the image forming steps are not interrupted.

Namely, although the surface temperature of heat roller 20 is lowered, the image forming direction is rotated and changed to the vertically long direction, and the ends of heat roller 20 which may cause defective fixing are not used, thus the image forming steps can be continued without interruption, and satisfactory fixing can be obtained. Furthermore, when the surface temperature at the ends of heat roller 20 is increased to 180° C. or higher during continuation of the image forming steps in the vertically long direction, the image forming direction is rotated and changed again to the horizontally long direction and the image forming steps are continued.

However, when the surface temperature at the ends of heat roller 20 is decreased to lower than 160° C. during the image forming steps, if the image size is large, or in cassette mechanism 3, no sheet of paper P in the vertically long direction is set, or the finish process by finisher 27 is designated, at Step 116, the image forming step is interrupted once and the process must wait for detection of that the surface temperature at the ends of heat roller 20 is increased to 180° C. or higher.

According to the first embodiment, during continuous image forming, when the surface temperature at the ends of heat roller 20 is decreased to lower than 160° C., the image forming direction is rotated to the vertically long direction without interrupting the image forming steps. By doing this, satisfactory fixing can be obtained without using the ends of heat roller 20. Therefore, the reduction in the productivity of images due to interruption of the image forming steps can be prevented and fixed toner images of high image quality can be obtained efficiently.

Next, the second embodiment of the present invention will be explained. The second embodiment is different in the heating member for heating the heat roller in the first embodiment.

Figure 7:
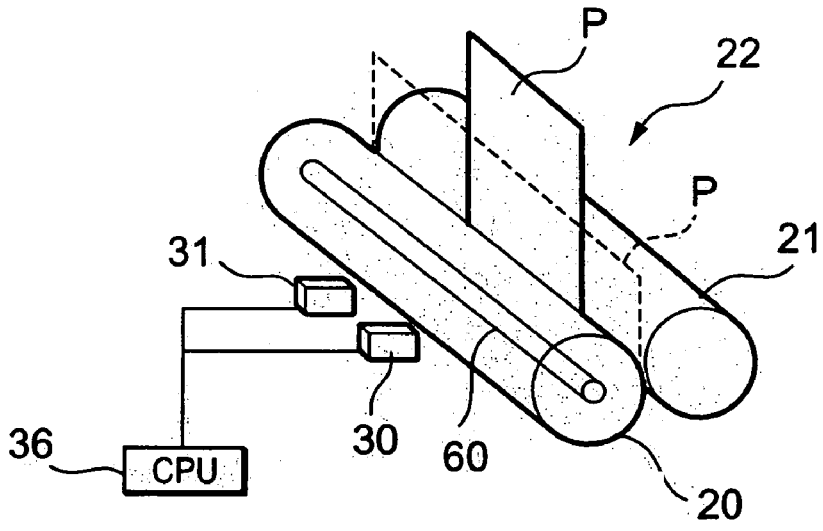
FIG. 7 is a schematic illustration showing the fixing device of the second embodiment of the present invention.

Therefore, in the second embodiment, to the same parts as those of the constitution explained in the first embodiment, the same numerals are assigned and the detailed explanation thereof will be omitted. In this embodiment, as shown in FIG. 7, heat roller 20 has built-in electromagnetic induction coil (hereinafter abbreviated to IH) 60 which is a heating member. IH 60 is formed in the almost same length as the width of heat roller 20 and after start of warm-up, is controlled so as to turn on or off, thereby keeps the surface temperature of heat roller 20 at about 180° C. which is a control temperature.

Figure 8:
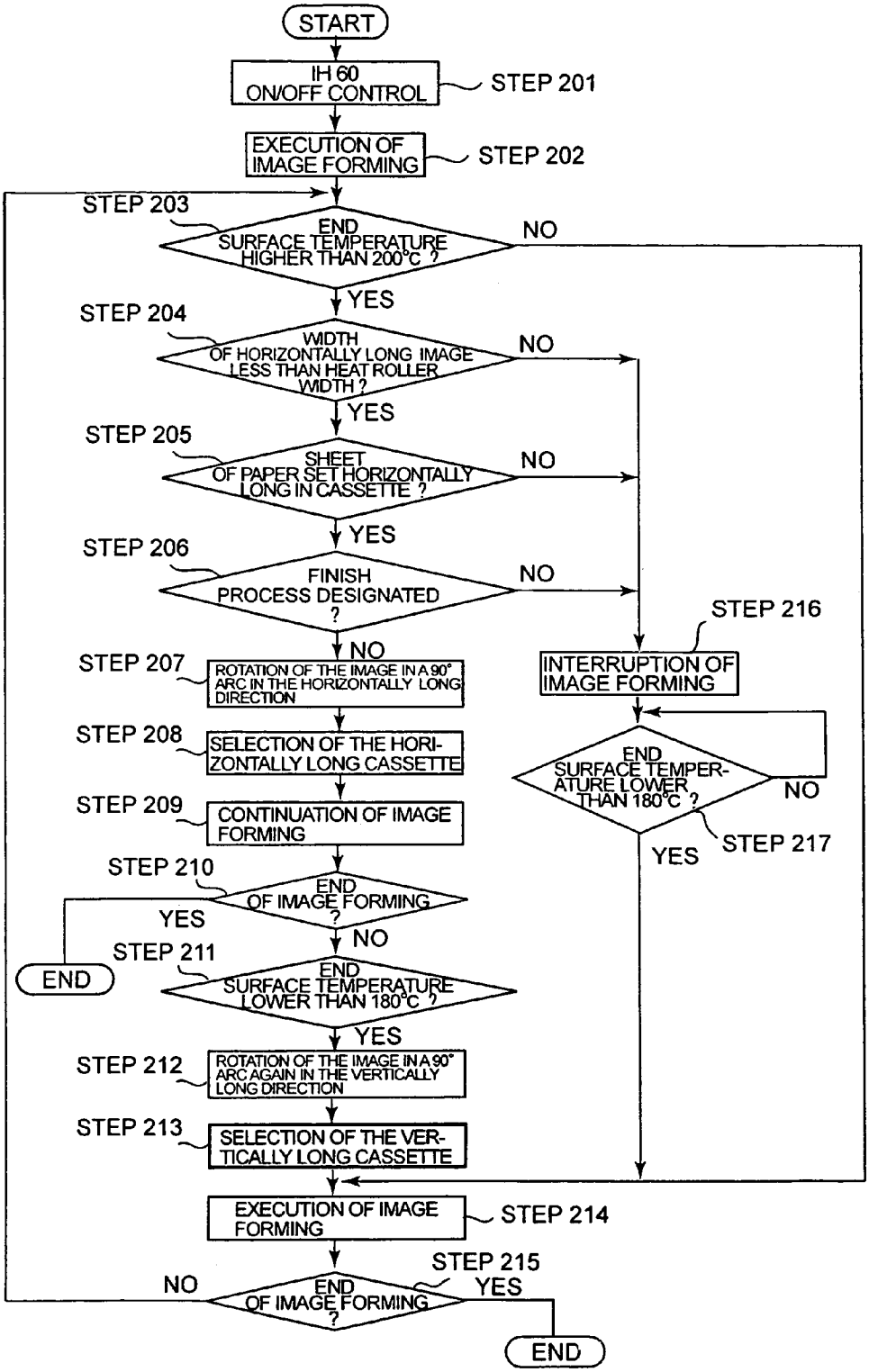
FIG. 8 is a flow chart showing control when the temperature at the end of the heat roller is increased in the second embodiment of the present invention.

In fixing device 22 for heating heat roller 20 by IH 60 in this way, in the same way as with the first embodiment, during execution of the image forming steps, control when the surface temperature at the ends of heat roller 20 is increased, for example, by continuously forming images of a size of A4 in the vertically long direction will be described in detail by referring to the flow chart shown in FIG. 8.

As shown at Step 201, during ready after the power source is turned on, by on or off control of IH 60, the surface temperature of heat roller 20 is kept at about 180° C. At Step 202, according to the image forming steps similar to the first embodiment, using sheets of paper P of A4-R, image forming of a size of A4 in the vertically long direction is executed. At this time, in cassette mechanism 3, vertically long cassette 3*b* is selected or manual paper supply mechanism 4 is selected.

When the image forming steps are continuously executed and a predetermined time elapses, at Step 203, whether the surface temperature at the ends of heat roller 20 detected by side thermistor 31 is 200° C. or higher or not is compared. At Step 203, when the surface temperature at the ends of heat roller 20 is lower than 200° C., the process goes to Step 214 and continues the image forming step, and when the necessary number of images are formed at Step 215, all the image forming steps are finished. At Step 215, when the image forming step is continued, the process returns to Step 203.

At the time of fixing, sheets of paper P, as indicated by a solid line in FIG. 7, pass only the central part of heat roller 20. Therefore, heat is accumulated at the ends of heat roller 20. When side thermistor 31, at Step 203, detects that the surface temperature at the ends of heat roller 20 is increased to 200° C. or higher, the process goes to Step 204.

At Step 204, when the image forming direction is set to the horizontally long direction, whether the width of the image size is the width of heat roller 20 or narrower is compared. When the width of the image size is wider than the width of heat roller 20, the process goes to Step 216 and when the width of the image size is the width of heat roller 20 or narrower, the process goes to Step 205. At Step 216, the image forming step is interrupted. Next, at Step 217, when side thermistor 31 detects that the surface temperature at the ends of heat roller 20 is decreased to less than 180° C., the process goes to Step 214.

At Step 205, in correspondence to a case that the image forming direction is set to the horizontally long direction, in cassette mechanism 3, for example, whether sheets of paper P of a size of A4 are set in the horizontally long direction or not is compared. When sheets of paper P in the horizontally long direction are not set, the process goes to Step 216. In cassette mechanism 3, when sheets of paper P are set in the horizontally long direction, the process goes to Step 206. At Step 206, finish discriminator 43 compares whether the finish process (for example, the sorting process or stable process) is designated by finisher 27 or not. When finish discriminator 43 discriminates that the finish process is designated, the process goes to Step 216 and when it discriminates that the finish process is not designated, the process goes to Step 207.

At Step 207, to use both ends of heat roller 20 at the time of fixing, image processor 42 converts the image address and rotates the image forming direction in a 90° arc to set the horizontally long direction. Next, at Step 208, to change sheet of paper P, horizontally long cassette 3*a* for storing sheet of paper P in the horizontally long image forming direction in cassette mechanism 3 is reselected, and at Step 209, according to the aforementioned image forming step, image forming in the horizontally long direction rotated in a 90° arc is executed. At this time, horizontally long sheet of paper P of a size of A4, as shown by a dotted line in FIG. 7, the full width of heat roller 20 is used for fixing, so that the surface temperature at both ends of heat roller 20 is lowered.

The image forming step is continued at Step 209 and after a lapse of a predetermined time, when the necessary number of images are formed at Step 210, all the image forming steps are finished. When the image forming step is continued, at Step 211, whether the surface temperature at the ends of heat roller 20 detected by side thermistor 31 is decreased lower than 180° C. or not is compared. When it is 180° C. or higher, the process returns to Step 210. At Step 211, when side thermistor 31 detects that the surface temperature at the ends of heat roller 20 is decreased lower than 180° C., the process goes to Step 212.

At Step 212, image processor 42 converts the image address and rotates the image forming direction again in a 90° arc to convert it again to the vertically long direction. Next, at Step 213, vertically long cassette 3*b* for storing sheet of paper P of A4-R which is vertically long sheet of paper P of a size of A4 is selected again and at Step 214, the image forming step in the vertically long direction rotated in a 90° arc is executed again. Then, the process goes to Step 215 and depending on whether the necessary number of images are formed or not, the process returns to Step 203 or all the image forming steps are finished.

According to the second embodiment, during continuous image forming, when the surface temperature at the ends of heat roller 20 is increased to 200° C. or higher, if sheet of paper P in the horizontally long direction is set and the finish process by finisher 27 is unnecessary, the image forming direction of vertically long A4-R is rotated and changed to the horizontally long direction. By doing this, without interrupting the image forming steps, the surface temperature at the ends of heat roller 20 can be lowered immediately and satisfactory fixing can be obtained. Therefore, an abnormal rise of the surface temperature of heat roller 20 can be effectively prevented, and the reduction in the productivity of images due to interruption of the image forming steps can be prevented, and fixed toner images of high image quality can be obtained efficiently.

Further, the present invention is not limited to the aforementioned embodiments and can be variously modified within the range of the present invention, and for example, the fixing control temperature of the fixing member is not limited and can be optionally set according to toner characteristics. Further, the constitution of the image forming apparatus is optional and it may be a full-color image forming apparatus or may have no finisher.

Furthermore, the image size, when the width of the image size in the horizontally long direction is the width of the fixing member or narrower, is not limited. Further, the fixing member is not limited to the roller shape and may be a belt-shaped fixing member.

As described above in detail, according to the present invention, when the surface temperature at the ends of the fixing member rises abnormally or becomes insufficient, by rotating the image forming direction and changing the width of recording media passing the fixing member, satisfactory fixed images can be obtained without interrupting the image forming steps. Therefore, the reduction in the productivity of images due to interruption of the image forming steps can be prevented and fixed toner images of high image quality can be obtained efficiently.

What is claimed is:

1. An image forming apparatus capable of changing an image forming direction, comprising:

an image forming unit configured to form a toner image on a recording medium;

a fixing member to hold and convey the recording medium and heat, press, and fix the toner image on the recording medium;

a heating member to heat the fixing member;

a center thermistor to detect a surface temperature at a central part of the fixing member;

a side thermistor to detect a surface temperature at an end of the fixing member;

a feed portion configured to feed the recording medium to the image forming unit; and a controller configured to judge the surface temperature at the end of the fixing member, rotate and control a forming direction of the toner image by the image forming unit, and select and control the recording medium arranged in the same direction as the forming direction of the toner image from the feed portion.

2. The image forming apparatus capable of changing an image forming direction according to claim 1, wherein a width of the toner image, in either of a horizontally long direction and a vertically long direction, is a width of the fixing member or narrower.

3. The image forming apparatus capable of changing an image forming direction according to claim 1, wherein the controller rotates and controls the image forming direction of the toner image in a vertically long direction when the surface temperature on the side of the fixing member is decreased lower than a predetermined temperature.

4. The image forming apparatus capable of changing an image forming direction according to claim 1, wherein the controller rotates and controls the image forming direction of the toner image in a horizontally long direction when the surface temperature on the side of the fixing member is increased higher than a predetermined temperature.

5. The image forming apparatus capable of changing an image forming direction according to claim 1, wherein the feed portion has a cassette in a vertically long direction for storing the recording medium of the same size in a vertically long direction and a cassette in a horizontally long direction for storing the recording medium in a horizontally long direction.

6. The image forming apparatus capable of changing an image forming direction according to claim 1, wherein the heating member includes a center heating member to heat a central part of the fixing member and side heating members provided on both sides of the center heating member to heat a side of the fixing member and the center heating member and the side heating members are alternately driven.

7. The image forming apparatus capable of changing an image forming direction according to claim 1, wherein a rotational angle of the toner image in the forming direction is 90°.

8. The image forming apparatus capable of changing an image forming direction according to claim 1, wherein the fixing member includes a pair of fixing rollers.

9. An image forming apparatus capable of changing an image forming direction, comprising:

an image forming unit configured to form a toner image on a recording medium;

a fixing member to hold and convey the recording medium and heat, press, and fix the toner image on the recording medium;

a heating member to heat the fixing member;

a center thermistor to detect a surface temperature at a central part of the fixing member;

a side thermistor to detect a surface temperature at an end of the fixing member;

a feed portion configured to feed the recording medium to the image forming unit;

a finish discrimination portion to discriminate an ejection state of the recording medium after passing of the fixing member; and a controller configured to judge the surface temperature at the end of the fixing member and the discrimination result by the finish discrimination portion, rotate and control the forming direction of the toner image by the image forming unit, and select and control the recording medium arranged in the same direction as the forming direction of the toner image from the feed portion.

10. The image forming apparatus capable of changing an image forming direction according to claim 9, wherein a width of the toner image, in either of a horizontally long direction and a vertically long direction, is a width of the fixing member or narrower.

11. The image forming apparatus capable of changing an image forming direction according to claim 9, wherein the controller rotates and controls the image forming direction of the toner image in a vertically long direction when the surface temperature on the side of the fixing member is decreased lower than a predetermined temperature.

12. The image forming apparatus capable of changing an image forming direction according to claim 9, wherein the controller rotates and controls the image forming direction of the toner image in a horizontally long direction when the surface temperature on the side of the fixing member is increased higher than a predetermined temperature.

13. The image forming apparatus capable of changing an image forming direction according to claim 9, wherein the feed portion has a cassette in a vertically long direction for storing the recording medium of the same size in a vertically long direction and a cassette in a horizontally long direction for storing the recording medium in a horizontally long direction.

14. The image forming apparatus capable of changing an image forming direction according to claim 9, wherein the heating member includes a center heating member to heat a central part of the fixing member and a side heating members provided on both sides of the center heating member to heat a side of the fixing member and the center heating member and the side heating members are alternately driven.

15. The image forming apparatus capable of changing an image forming direction according to claim 9, wherein a rotational angle of the toner image in the forming direction is 90°.

* * * * *